US005373980A

United States Patent [19]

Rowell et al.

[11] Patent Number: 5,373,980

[45] Date of Patent: Dec. 20, 1994

[54] LENS CASE WITH SELECTIVE CIRCUMFERENTIAL COMPRESSION

[75] Inventors: Galen A. Rowell, Berkeley; Hans M. Wain, Truckee, both of Calif.

[73] Assignee: PHO, Santa Cruz, Calif.

[21] Appl. No.: 705,502

[22] Filed: May 24, 1991

[51] Int. Cl.[5] ..... A45F 5/00

[52] U.S. Cl. ..... 224/240; 224/253; 224/242; 224/251; 224/908; 224/901; 224/250; 383/2; 206/316.1

[58] Field of Search ..... 224/908, 253, 240, 228, 224/235, 236, 240, 241, 231, 246, 242, 250, 901; 206/316.1, 316.2; 383/2; 150/154

[56] References Cited

U.S. PATENT DOCUMENTS

| | | | |
|---|---|---|---|
| D. 257,079 | 9/1980 | Globus | 206/316.2 |
| 1,530,342 | 3/1925 | Barber | 224/250 |
| 1,703,620 | 2/1929 | Hamilton | 383/2 |
| 4,330,073 | 5/1982 | Clark | 224/223 |
| 4,549,589 | 10/1985 | Nguyen | 206/316.2 |
| 4,661,989 | 4/1987 | Risby | 383/2 |
| 4,751,923 | 6/1988 | Marino | 224/901 |
| 4,836,427 | 6/1989 | McManus | 224/901 |
| 4,957,231 | 9/1990 | Kalisher | 224/253 |
| 4,964,161 | 10/1990 | Trowbridge, Jr. | 379/451 |

FOREIGN PATENT DOCUMENTS 2084866 4/1982 United Kingdom ..... 206/316.1

OTHER PUBLICATIONS

Tamrac TM 1987 Catalog, p. 13, Item N-527.

*Primary Examiner*—Linda J. Sholl

*Attorney, Agent, or Firm*—Michael J. Hughes; Bradley T. Sako

[57] ABSTRACT

A camera lens case (10) is provided, having a generally tubular case body (4) with a plurality of adjustment strap assemblies (18) attached thereto such that the case body (14) may be constricted inward so as to closely support lenses (12, 54, 56 contained therein even when the lenses (12, 54, 56 may differ as to size or shape, or when the lenses are of irregular shape. A case lid (16) is flexibly attached to the case body (14) for securing the lenses (12, 54, 56 within the lens case (10) and a zipper (48) is provided for holding the case lid (16) closed. A belt loop (52) is provided for optionally carrying the camera lens case (10) thereby. The camera lens case (10 ) may optionally be used as a divider within a larger conventional camera bag (60).

4 Claims, 3 Drawing Sheets

LENS CASE WITH SELECTIVE CIRCUMFERENTIAL COMPRESSION

TECHNICAL FIELD

The present invention relates generally to camera equipment carrying apparatus, and more particularly to an improved means for carrying a camera lens or lenses upon the person of a photographer. The predominant current usage of the lens case with selective circumferential compression of the present invention is as a means for transporting camera lenses comfortably while providing optimal protection for the lenses.

BACKGROUND ART

Camera lens carrying cases of various types are known in the art. These are frequently of a generally tubular shape and have traditionally been made of a semi-rigid material such as leather. A variation is to construct the lens case from a more flexible material, such as cloth. The lens cases may be either padded or unpadded.

A problem which exists in relation to camera lens cases is that camera lenses are available in a great variety of lengths and girths. This has resulted in the fact that a photographer must often purchase as many lens cases as he or she has lenses in order to accommodate them all. This situation is particularly unfortunate in that the lens cases may not be often used. The lenses may normally be stored and carried in a large equipment case, and a lens case might only be used during the occasional instance wherein the photographer wishes to travel lightly with, for instance, only a single camera body and one or two spare lenses. This means that the lens cases are, except during those relatively unusual usages, an unnecessary burden which take up valuable space in a camera equipment bag.

Various attempts have been made to make a camera lens case which is more versatile, in that it will accommodate lenses of differing sizes and/or a plurality of such lenses. Since lenses are quite fragile, they must be protected against being jostled about within the lens case. Therefore, any such case must provide some means for fitting the size of the case to the lens size. One such device is taught by U.S. Pat. No. 4,330,073 issued to Clark. The exterior of the Clark invention resembles three lens cases, each of a different size, grafted together. It will simultaneously carry therein a variety of different lenses. The Clark invention provides a unique solution which is quite useful in those applications for which it is intended. Nevertheless, it would seem that a need remains for a lens case which provides versatility similar to that provided by the Clark invention in a form which is less intrusive of space in a camera equipment case, and which is thus likely to be at hand to meet a spontaneous need in the field.

To the inventors' knowledge, all of the prior art camera lens cases have not been adapted for carrying a variety of different lenses of varying sizes and shapes, or else they have been large and difficult to store away when not in use.

None of the prior art single camera lens cases within the inventors' knowledge have been sufficiently versatile to adapt to various sized lenses without being too large to conveniently store in a camera case or else they have required an assortment of adaptive accessories to adapt to the different lens sizes.

No prior art camera lens cases, to the inventor's knowledge have provided a means to optionally carry either a single large lens or a plurality of smaller lenses in a compact configuration.

Furthermore, no prior art camera lens case within the inventors' knowledge has been well suited for carrying the lenses within a larger camera case, such that the lenses are easily accessible to the photographer, while the lens carrying case does not take up valuable space within the camera bag.

All successful applications to date have either not been capable of holding a lenses of various sizes and shapes, or else have not been adaptable to carry a plurality of smaller lenses, or else have been too bulky to store conveniently when they are not in use.

DISCLOSURE OF INVENTION

Accordingly, it is an object of the present invention to provide a camera lens case which is adaptable to carry lenses of various sizes and shapes.

It is another object of the present invention to provide a camera lens case which is adaptable to carry a plurality of lenses.

It is still another object of the present invention to provide a camera lens case which does not take up valuable storage space when it is not in use.

It is yet another object of the present invention to provide a camera lens case which furnishes adequate protection for fragile lenses.

It is still another object of the present invention to provide a means for carrying camera lenses which can be combined with other camera equipment carrying devices to create an integrated system.

It is yet another object of the present invention to provide a means for carrying camera lenses which is convenient and comfortable to carry.

It is still another object of the present invention to provide a camera lens case which can be quickly and easily accessed by the user while it is being carried or worn.

It is yet another object of the present invention to provide a camera lens carrying case which does not waste space in a camera bag when stored therein.

It is still another object of the present invention to provide a camera lens carrying apparatus which can be used in conjunction with additional camera equipment carrying devices.

Briefly, the preferred embodiment of the present invention is a lens case having a generally tubular shape flattened somewhat on one side and closed at one end. The tubular portion of the case is padded and flexible. Two circumferential straps are positioned along the length of the case such that by shortening the straps the circumference of the case, and the effective cross sectional area of the interior, may be reduced at the locality of each of the straps individually. By this means, a lens enclosed within the case is closely supported by the tubular structure of the case. Because the straps are individually adjustable, they may be adjusted to adapt to closely support two lenses of different sizes or, alternatively, they may be adjusted to support a single lens even if that lens such as some telephoto lenses varies in diameter along its length.

A belt loop is provided along the flattened side of the tubular structure for attaching the inventive lens case to a carrying belt or strap, and a lid is flexibly attached to the flattened side of the tubular structure for covering the open end of the tubular structure. In the best presently known embodiment of the invention, the lid is secured to the tubular structure by means of a zipper such that the lid may be unzipped from the tubular structure and hinged along the flattened side for gaining access to the lenses within the tubular structure.

The lid is sufficiently thin and flexible to lie along the exterior of the flattened portion of the case such that, when the inventive camera lens case is to be itself carried within a camera bag, the lens case can function as an additional padded divider within the camera bag. Access to the lens therein is not impeded thereby, and the inventive camera lens case provides protection for the lens while not itself taking up valuable space within the camera bag.

An advantage of the present invention is that a camera lens may be carried therein and closely supported thereby regardless of the size or shape of the lens.

A further advantage of the present invention is that camera lenses of various sizes are closely supported such that they are not damaged by being bounced about within the lens case.

Still another advantage of the present invention is that a plurality of lenses can be carried within the case simultaneously, even if those lenses are of different sizes.

Yet another advantage of the present invention is that the lens case may be stored within a camera bag with the lenses therein without hindering access to the lenses, and without taking up an undue amount of space within the camera bag.

Yet another advantage of the present invention is that one or more lenses can be comfortably carried while maintaining ready and rapid accessibility.

Still another object of the present invention is that the camera lens case can be used in conjunction with additional camera equipment carrying devices to create an integrated camera equipment carrying system.

These and other objects and advantages of the present invention will become clear to those skilled in the art in view of the description of the best presently known mode of carrying out the invention and the industrial applicability of the preferred embodiment as described herein and as illustrated in the several figures of the drawing.

BEST MODE FOR CARRYING OUT INVENTION

The best presently known mode for carrying out the invention is a soft sided camera lens case having two circumferential straps attached such that the interior volume and shape of the case can be varied thereby in order to accommodate and closely support diverse lenses therein. The case has a belt loop for optionally attaching a carrying belt or strap. A case lid is provided which optionally closes the case opening and secures the contents therein, or else folds out of the way to enable the lens case to be used as a divider in a camera bag.

The predominant expected usage of the inventive camera lens case with selective circumferential compression is as a component of a photographer's gear which can be optionally carried within a larger camera bag or worn on the person of the photographer when only a small variety of lenses is needed and when the photographer is engaged in activities wherein he or she does not want to be overburdened with unnecessary equipment.

Figure 1:
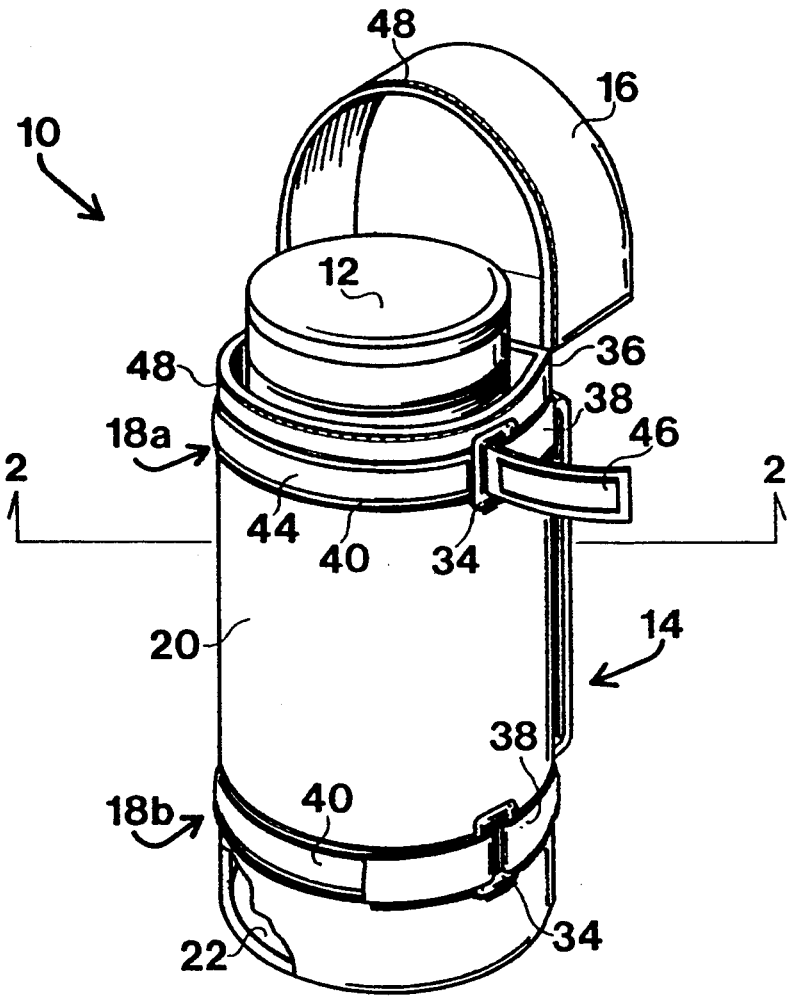
FIG. 1 is a partially cut away front perspective view of a camera lens case with selective circumferential compression, according to the present invention.

The camera lens case with selective circumferential compression of the present invention is illustrated in a partially cut away "front" perspective view in FIG. 1 and is designated therein by the general reference character 10. The lens case 10 is intended to optionally contain a conventional relatively long lens 12 and includes a generally tubular case body 14 and a case lid 16. A pair of adjustment strap assemblies 18, including a top adjustment strap assembly **18*a* and a bottom adjustment strap assembly 18*b*, are provided for independently cinching the case body 14 snugly against the lens 12 and thereby closely supporting the lens 12 within the case body 14**.

The case body 14 has a case wall portion 20 and a bottom 22, which can be seen in the view of FIG. 1 through a cut away portion of the case wall portion 20. Unless otherwise specified herein, all components of the best presently known embodiment 10 of the invention are attached by means of sewing, although other methods of attachment, such as gluing, would be within the scope of the invention.

Figure 2:
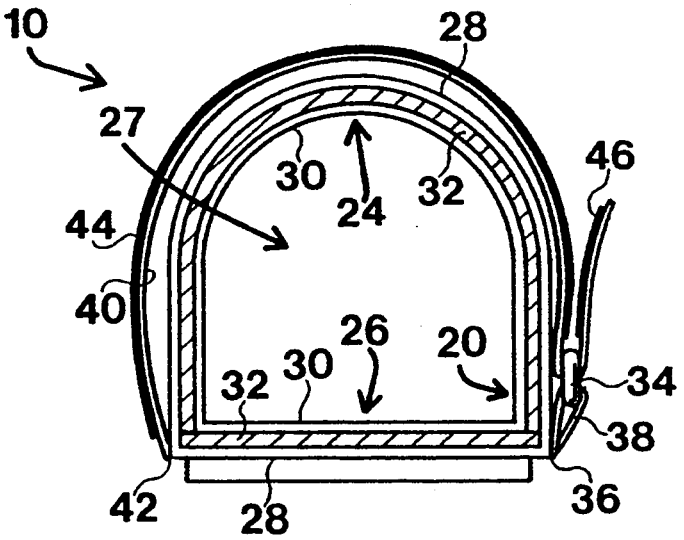
FIG. 2 is a cross sectional view of the lens case of the present invention, taken along line 2-2 of FIG. 1.

FIG. 2 is a cross sectional view of the case body 14 taken along line 2—2 of FIG. 1. As can be seen in the view of FIG. 2, the case wall portion 20 has curved front wall 24 attached to a flat rear wall 26. The curved front wall 24 and the flat rear wall 26 enclose an interior space 27 of the case body 14 within which the lens 12 (FIG. 1) is contained.

Both the curved front wall 24 and the flat rear wall 26 are constructed with an outer covering 28 and an inner lining 30. In the best presently known embodiment 10 of the invention both the outer covering 28 and the inner lining 30 are made of a heavy gauge rip stop nylon. A thin foam pad 32 is contained between the outer covering 28 and the inner lining 30. The combination of the outer covering 28, the inner lining 30 and the foam pad 32 provides padding and protection for the lens 12 while leaving the case body 14 sufficiently flexible to be used as will be described hereinafter.

Referring again to FIG. 1, it can be seen that each of the adjustment strap assemblies has a "D" ring 34 secured to a right end 36 of the flat rear wall 26 by means of a "D" ring attachment loop 38. A circumferential strap 40 is attached to a left end 42 (FIG. 2) of the flat rear wall 26 and is bent around the curved front wall 24 and threaded through the "D" ring 34. As can be seen in the views of FIG. 1 and FIG. 2, each of the circumferential straps 40 has a Velcro fastener loop strip attached along its outer surface near the proximal ends of the circumferential straps 40 and, on those same surfaces near the distal ends, a Velcro fastener hook strip is attached to each of the circumferential straps 40. Furthermore, as can be seen in both the drawings of FIG. 1. and FIG. 2, the circumferential straps 40 are bent back upon themselves after they are threaded through the "D" rings 34, as heretofore described, such that the fastener hook strips 46 are caused to mate with the fastener loop strips 44 and to be removably attached thereto.

Since, as has been heretofore described, the walls 24 and 26 of the case body 14 are flexible, the circumferential straps 40 may be pulled through the "D" rings 34 sufficiently to cause the cross sectional aspect of the interior space 27 (FIG. 2) of the case body 14 to be reduced. This action causes the walls 24 and 26 of the case body 14 to be drawn inward against the lens 12 (FIG. 1), thereby closely supporting the lens 12.

The case lid 16 is made from the same material as is the outer covering 28 of the case body 14. In the best presently known embodiment 10 of the invention, the case lid 16 is not padded as are the walls 14 and 26 of the case body 14. This is to ensure that the case lid 16 is sufficiently flexible to easily be bent back against the case body 14 such that it does not restrict access to the interior space 27, and further such that it will be out of the way when the lens case 10 is optionally used as will be described hereinafter in relation to the industrial applicability of the invention. The case lid 16 may be closed over the case body 14 (as is shown in the view of FIG. 3) to completely enclose the interior space 27, and may be secured therein place by means of a zipper 48.

Figure 3:
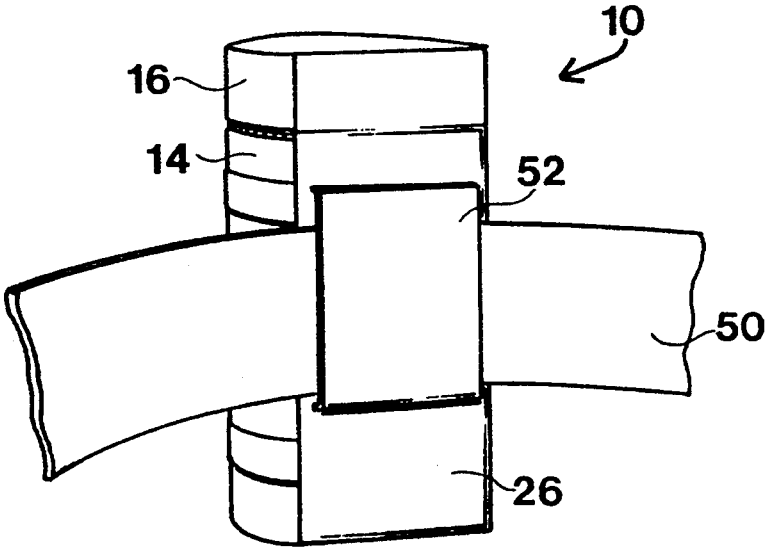
FIG. 3 is a rear perspective view of the lens case of the present invention.

FIG. 3, wherein is a "rear" perspective view of the camera lens case 10. In the view of FIG. 3, a belt 50 is shown threaded through a belt loop 52. The belt loop 52 is sewn to the flat rear wall 26. The belt 50 is an optional accessory of the camera lens case 10. Alternatively, the belt 50 may be supplied by the end user and may be a functioning part of another piece of camera equipment, such as a camera bag (not shown).

Figure 4:
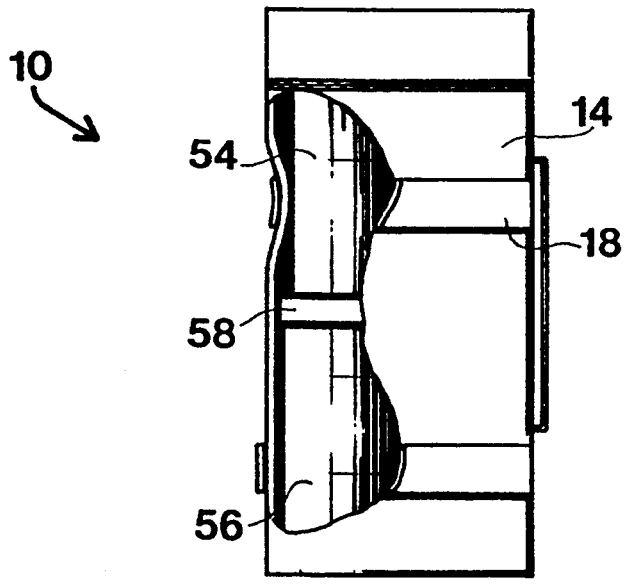
FIG. 4 is a partially cut away side elevational view of the inventive camera lens case showing two small lenses placed therein.

FIG. 4 is a partially cut away side elevational view of the camera lens case 10. In the view of FIG. 4 it can be seen that, instead of containing a single long lens 12 (FIG. 1), the camera lens case 10 may optionally be employed to transport a plurality of shorter lenses such as a first short lens 54 and a second short lens 16 depicted in the example of FIG. 4. In this example, the first short lens 54 is longer and of a smaller diameter as compared to the second short lens 56. Nevertheless, both of the short lenses 54 and 56 are closely supported by the case body 14. In order to accomplish this, the top adjustment strap assembly 18*a* is drawn snug such that the first short lens 54 is thus supported, and the bottom adjustment strap assembly 18*b* is separately and independently drawn snug such that the second short lens 56 is thus supported. A circular foam pad 58 is optionally provided for separating the first short lens 54 from the second short lens 56.

As is shown above, in great part, the camera lens case 10 according to the present invention closely resembles prior art conventional camera lens cases in many respects. Among the substantial differences are the inclusion of the adjustment strap assemblies 18 for causing the inventive camera lens case 10 to closely support the elongated lens 12 or, optionally, to support a plurality of shorter lenses such as the first short lens 54 and the second short lens 56, and the unique case lid 16 which folds out of the way, the utility of which will be discussed in more detail hereinafter in relation to the industrial applicability of the invention. No significant changes of materials are envisioned nor are any special constructions required.

Various modifications may be made to the invention without altering its value or scope. For example, various individual aspects of the inventive combination might be deleted for the sake of economy.

Another conceivable change would be to provide alternative means for carrying the camera lens case 10, such as an integral belt, or rings whereby a shoulder strap might be attached.

Yet another conceivable change would be to vary the non-inventive aspects of the invention so as to create a device quite dissimilar in appearance from the best presently known embodiment 10 of the present invention described herein, while retaining the unique aspects of the invention. For example, the camera lens case 10 might be made more perfectly tubular in shape, as opposed to having the flat rear wall 26 joined to the curved front wall 24, as described herein.

All of the above are only some of the examples of available embodiments of the present invention. Those skilled in the art will readily observe that numerous other modifications and alterations may be made without departing from the spirit and scope of the invention. Accordingly, the above disclosure is not intended as limiting and the appended claims are to be interpreted as encompassing the entire scope of the invention.

INDUSTRIAL APPLICABILITY

The inventive camera lens case 10 is adapted to be widely used in the field of photography. The predominant current expected usages are for outdoor field usages wherein a photographer is engaged in physical activity such as bicycling or climbing, and for those applications wherein only a limited variety of camera equipment is needed.

The camera lens case 10 of the present invention may be utilized in any application wherein conventional camera lens cases are used. The main areas of improvement are in the ability to adapt to sequentially closely support a great variety of elongated lenses or, alternatively, to simultaneously closely support a plurality of shorter lenses.

To use the camera lens case 10 in its primary intended mode the elongated lens 12 is placed in the case body 14 and the adjustment strap assemblies 18 are independently adjusted in length as heretofore described so as to cause the case body 14 to fit snugly about the lens 12. It should be noted that this is easily accomplished even if the lens 12 is not regular in diameter along its entire length, as is the case with many conventional telephoto lenses. By this means the lens 12 is held within the case body 14 in much the same manner as it would be within a custom fitted case, the difference being that the inventive lens case 10 is easily adaptable to fit a wide variety of sizes of cameras lenses 12. In order to more completely enclose and protect the lens 12, the case lid 16 is then normally closed over the case body 14 and secured there in place by means of the zipper 48.

The camera lens case 10 is normally transported by means of the belt 50. As has been previously disclosed herein, the belt 50 may be provided by the end user, and further may support other camera equipment. Since it is intended that a photographer will most probably use the inventive camera lens case 10 on those occasions during which he or she may be carrying only, for example, a single camera with one or two spare lenses, it is envisioned that the camera lens case 10 may be supported on the belt 50 along with a small camera case adapted for carrying a single camera. As has been previously described herein, the camera lens case 10 may be employed to carry either a single longer lens 12 or a plurality of shorter lenses 54, 56.

Figure 5:
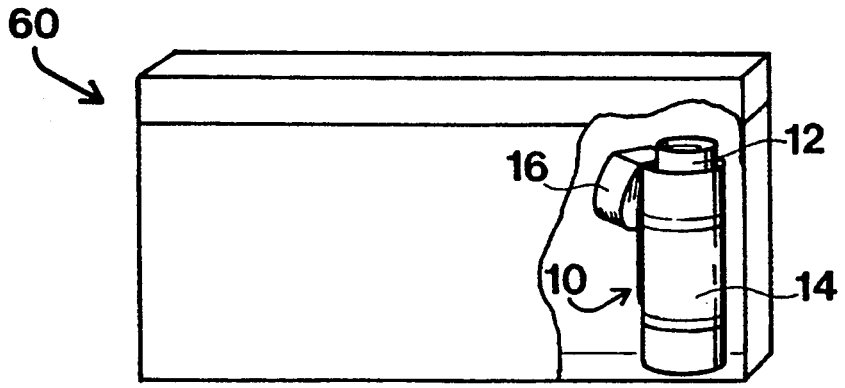
FIG. 5 is a partially cut away perspective view of a camera bag showing the inventive lens case placed therein.

Yet another mode of use of the inventive camera lens case 10 is as a component in a larger assortment of photography gear. FIG. 5 is a cut away perspective view of a large conventional camera bag 60 showing the camera lens case 10 therein. In accordance with the present invention, the case lid 16 has been folded back along the case body 14 to provide access to the lens 12 therein. In this configuration, the case body 14 acts as a divider within the camera bag 60, providing additional protection for the lens 12, while not hindering access thereto. The utility of the inventive camera lens case 10 is greatly enhanced by its use in this manner, since it is always at hand within the camera bag 60 when needed, and yet it does not take up an undue amount of space within the camera bag 60.

Since the camera lens cases carriers of the present invention may be readily constructed and are physically significantly similar to prior art conventional camera carriers it is expected that they will be acceptable in the industry as substitutes for the conventional camera carriers. For these and other reasons, it is expected that the utility and industrial applicability of the invention will be both significant in scope and long-lasting in duration.

We claim:

1. A lens case for carrying a lens therein, which lens may consist of a single lens or a plurality of lenses, comprising:

a case enclosure for containing the lens within, said case enclosure being generally tubular in shape and closed at one end; a case lid attached to said case enclosure such that said case lid hinges up from said case enclosure to permit access to the lens within said case enclosure; and at least one adjustment strap assembly attached to said case enclosure such that the volume of said case enclosure is variable according to the adjusted length of said adjustment strap assembly, wherein;

said adjustment strap assembly is attached at its ends to said case enclosure such that said adjustment strap assembly at least partially encircles said case enclosure, said case enclosure being generally flexible such that adjustment of said adjustment strap assembly causes said adjustment strap assembly to close upon and support the lens.

2. The lens case of claim 1, wherein:

said case lid is flexible such that it can be folded back against the case enclosure so as not to inhibit access to the case enclosure.

3. The lens case of claim 1, and further including:

a fastening means for fastening said case lid closed on the case enclosure such that said case lid is temporarily prevented from hinging upward from the case enclosure.

4. The lens case of claim 3 wherein:

said fastening means is a zipper affixed to the case lid and further affixed to the lens case such that, when the zipper is zipped closed, the case lid is held closed on the lens case, and when the zipper is zipped open the case lid is free to hinge upward from the case enclosure to permit access to the lens within the case enclosure.

* * * * *